US010332715B2

(12) United States Patent
Sun et al.

(10) Patent No.: US 10,332,715 B2
(45) Date of Patent: Jun. 25, 2019

(54) FUSION WELDING ISOLATION MECHANISM FOR OPERATION MECHANISM OF CIRCUIT BREAKER

(71) Applicants: SEARI ELECTRIC TECHNOLOGY CO., LTD., Shanghai (CN); ZHEJIANG CHINT ELECTRICS CO., LTD., Yueqing (CN)

(72) Inventors: Jisheng Sun, Shanghai (CN); Yong Li, Shanghai (CN)

(73) Assignees: SEARI ELECTRIC TECHNOLOGY CO., LTD., Shanghai (CN); ZHEJIANG CHINT ELECTRICS CO., LTD., Yueqing (CN)

( * ) Notice: Subject to any disclaimer, the term of this patent is extended or adjusted under 35 U.S.C. 154(b) by 73 days.

(21) Appl. No.: 15/569,431

(22) PCT Filed: Apr. 22, 2016

(86) PCT No.: PCT/CN2016/079965
§ 371 (c)(1),
(2) Date: Oct. 26, 2017

(87) PCT Pub. No.: WO2016/173462
PCT Pub. Date: Nov. 3, 2016

(65) Prior Publication Data

US 2018/0301309 A1 Oct. 18, 2018

(30) Foreign Application Priority Data

Apr. 28, 2015 (CN) ..... 2015 1 0209924

(51) Int. Cl.
*H01H 71/64* (2006.01)
*H01H 71/62* (2006.01)
(Continued)

(52) U.S. Cl.
CPC ..... *H01H 71/62* (2013.01); *H01H 71/10* (2013.01); *H01H 71/501* (2013.01);
(Continued)

(58) Field of Classification Search
CPC ..... H01H 71/62; H01H 71/64; H01H 71/501; H01H 2071/502
See application file for complete search history.

(56) References Cited

U.S. PATENT DOCUMENTS

2004/0263294 A1 12/2004 Ahlert et al.
2010/0193339 A1* 8/2010 Godesa ..... H01H 71/501 200/335

FOREIGN PATENT DOCUMENTS

CN 201112159 Y 9/2008
CN 101938233 A 1/2011
(Continued)

OTHER PUBLICATIONS

International Search Report issued in corresponding application No. PCT/CN2016/079965 dated Jul. 25, 2016 (4 pages).
(Continued)

*Primary Examiner* — Ramon M Barrera
(74) *Attorney, Agent, or Firm* — Osha Liang LLP

(57) ABSTRACT

A fusion welding isolation mechanism for an operating mechanism of a circuit breaker is provided. The operating mechanism of circuit breaker includes: a tripping component, a left side, a right side plate, a latch, a half shaft, a lever, and a main shaft. The tripping component, the latch, and the lever are mounted between the left side plate and the right side plate. The half shaft and the main shaft penetrate through the left side plate and the right side plate, and extend out of the left side plate and the right side plate. The tripping component, the latch, the half shaft, the lever, and the main shaft move in linkage. The lever and the main shaft are
(Continued)

provided with isolation devices for preventing an operation handle from an opening operation when a moving contact is subject to fusion welding.

6 Claims, 14 Drawing Sheets

(51) Int. Cl.
*H01H 71/10* (2006.01)
*H01H 71/50* (2006.01)
*H01H 71/52* (2006.01)

(52) U.S. Cl.
CPC ..... *H01H 71/521* (2013.01); *H01H 71/525* (2013.01); *H01H 71/64* (2013.01); *H01H 2071/502* (2013.01)

(56) References Cited

FOREIGN PATENT DOCUMENTS

| | | | |
|---|---|---|---|
| CN | 202405200 | U | 8/2012 |
| CN | 103441041 | A | 12/2013 |
| CN | 103681137 | A | 3/2014 |
| JP | H07-057593 | A | 3/1995 |

OTHER PUBLICATIONS

Written Opinion of the International Searching Authority issued in corresponding application No. PCT/CN2016/079965 dated Jul. 25, 2016 (3 pages).
First Office Action issued in corresponding application No. CN201510209924.7 dated Sep. 29, 2017, with translated search report (6 pages).

* cited by examiner

FUSION WELDING ISOLATION MECHANISM FOR OPERATION MECHANISM OF CIRCUIT BREAKER

BACKGROUND OF THE INVENTION

1. Field of the Invention

The present invention relates to the field of low-voltage electric apparatus, more particularly, relates to operation mechanism of switching electric apparatus.

2. The Related Art

A circuit breaker is a main switching electric apparatus which plays a protective role in a low-voltage power distribution network. The circuit breaker provides overload protection and short circuit protection for the network. A molded case circuit breaker is a type of the circuit breakers. A large capacity molded case circuit breaker refers to a circuit breaker with a rated current reaching or exceeding 800 A. Generally, such a circuit breaker has a three-pole and four-pole structure, namely the circuit breaker is provided with three or four groups of contacts, which correspond to a three-phase or four-phase circuit. An operation mechanism is in contact with all of the three or four groups of contacts. By operating the operation mechanism, the three or four groups of contacts can perform closing, opening or tripping at a same time.

In some cases, the contact may be subject to fusion welding. Fusion welding refers to that the moving contact and the static contact are melted due to high temperature, and therefore the moving contact and the static contact are fixed to each other and cannot be separated. As the operation mechanism is in linkage with the contact, when the moving contact and the static contact are subjected to fusion welding and cannot be separated, the operation mechanism cannot act as well. Fusion welding usually occurs when the circuit is conducted, so that the operation mechanism is locked at the closing position. At this time, if the operation mechanism is subjected to an opening operation by an external force, such as manual operation, the operation mechanism will be damaged.

SUMMARY

The present invention discloses a fusion welding isolation mechanism which can limit a stroke of an operation mechanism when a fusion welding occurs.

According to an embodiment of the present invention, a fusion welding isolation mechanism for operation mechanism of circuit breaker is disclosed. The operation mechanism of circuit breaker comprises: a tripping component, a left side plate component, a right side plate component, a latch component, a half shaft component, a lever component and a main shaft component. The tripping component, the latch component and the lever component are mounted between the left side plate component and the right side plate component, the half shaft component and the main shaft component penetrate through the left side plate component and the right side plate component and extend out of the left side plate component and the right side plate component. The tripping component, the latch component, the half shaft component, the lever component and the main shaft component move in linkage. The lever component and the main shaft component are provided with isolation devices for preventing an operation handle from an opening operation when a moving contact is subject to fusion welding.

According to an embodiment, the main shaft component comprises a main shaft with a plurality of cantilevers arranged thereon, a main shaft limiting piece is provided on the main shaft and a limiting block is provided on the main shaft limiting piece.

According to an embodiment, the lever component comprises a sheet metal bending piece, the sheet metal bending piece being bent to form a top wall and two side walls; a lever component spring is mounted on the sheet metal bending piece, the lever component spring is surrounded by the sheet metal bending piece, the sheet metal bending piece forms a shallow hook shaped extension part at a first end of the bottom of the two side walls.

According to an embodiment, the isolation devices comprise the limiting block on the main shaft limiting piece and the shallow hook shaped extension part on the sheet metal bending piece.

According to an embodiment, when a moving contact is subjected to fusion welding, the main shaft component in linkage with the moving contact is locked at the closing position and is not able to rotate; when the lever component rotates towards an opening direction under an external force, the limiting block on the main shaft liming piece is in contact with the shallow hook shaped extension portion on the sheet metal bending piece, so that the lever component is not able to reach the opening position.

According to an embodiment, when the external force disappears, the lever component spring generates a torque for driving the lever component to rotate towards a closing direction and reset.

The fusion welding isolation mechanism for operation mechanism of circuit breaker of the present invention can limit a rotation stroke of the operation mechanism towards an opening direction, so as to prevent the operation mechanism from being damaged by forced operation. After an external force disappears, the operation mechanism can reset to a closing position automatically.

BRIEF DESCRIPTION OF THE DRAWINGS

The above and other features, natures, and advantages of the invention will be apparent by the following description of the embodiments incorporating the drawings, wherein.

DETAILED DESCRIPTION OF EMBODIMENTS

Figure 1:
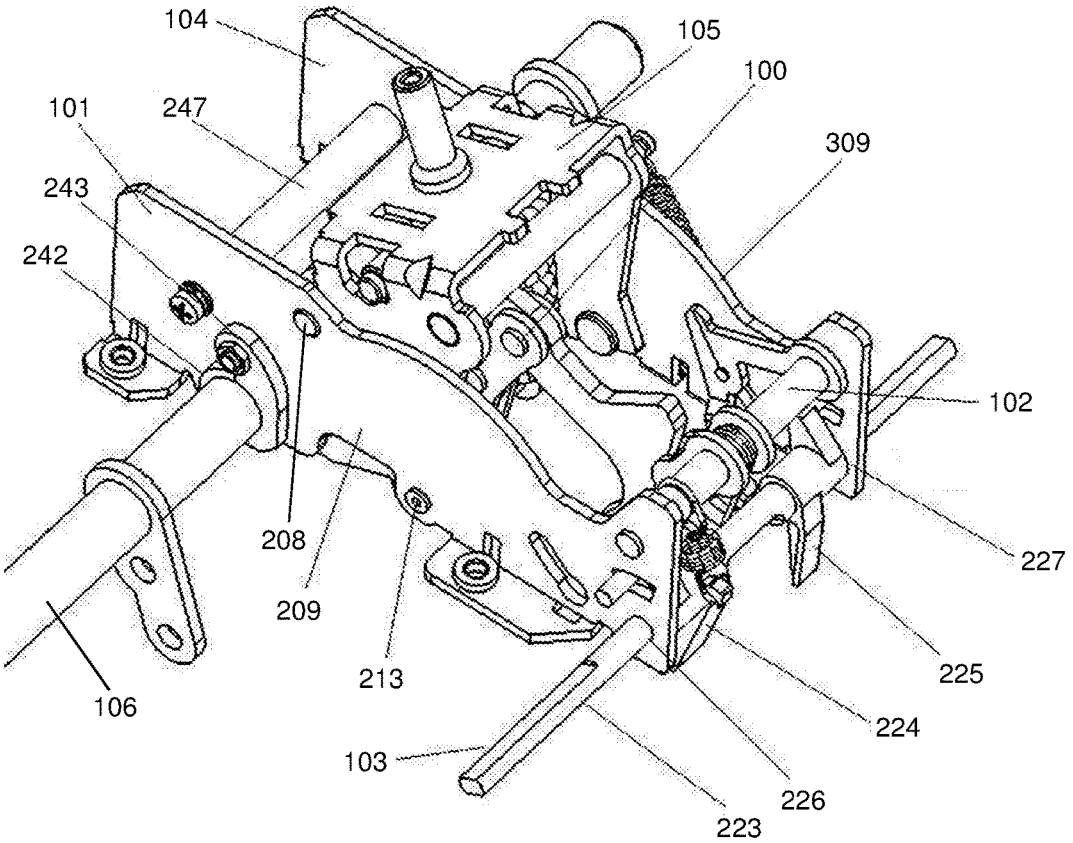
FIG. 1 illustrates a structural diagram of an operation mechanism of circuit breaker using a fusion welding isolation mechanism according to an embodiment of the present invention.

As shown in FIG. 1, FIG. 1 illustrates a structural diagram of an operation mechanism of circuit breaker according to an embodiment of the present invention. The operation mechanism 107 comprises: a tripping component 100, a left side plate component 101, a latch component 102, a half shaft component 103, a right side plate component 104, a lever component 105 and a main shaft component 106.

Figure 2A:
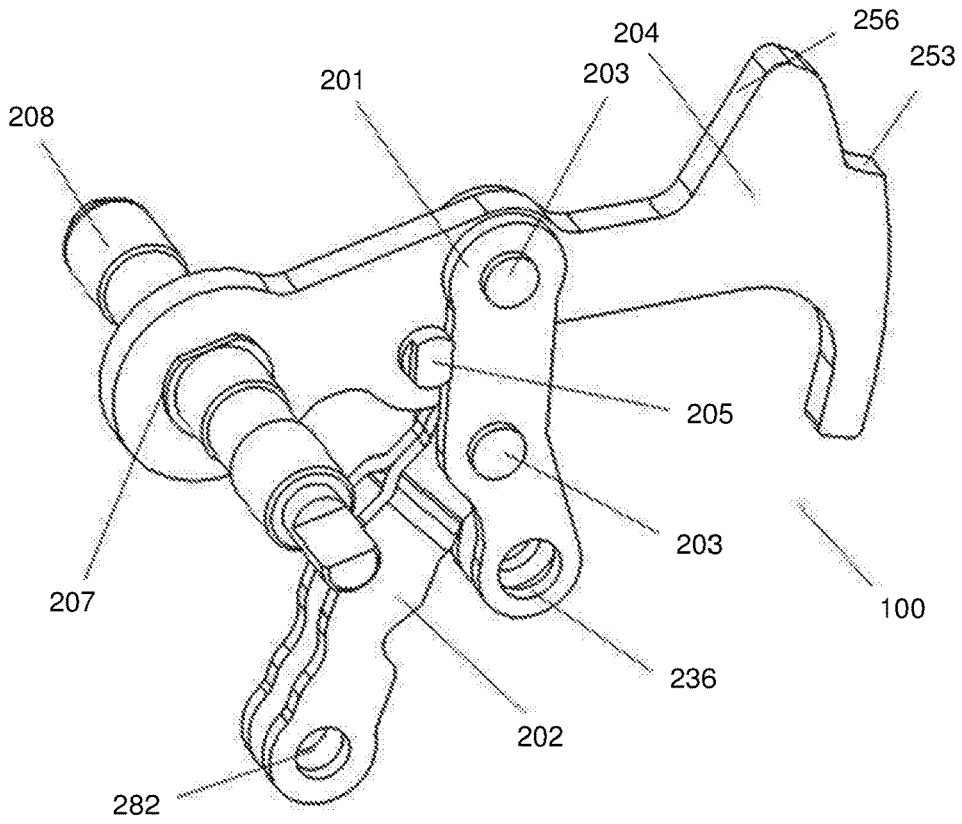
FIG. 2*a* and FIG. 2*b* illustrate a structural diagram of a tripping component of the operation mechanism of circuit breaker shown in FIG. 1.
Figure 2B:
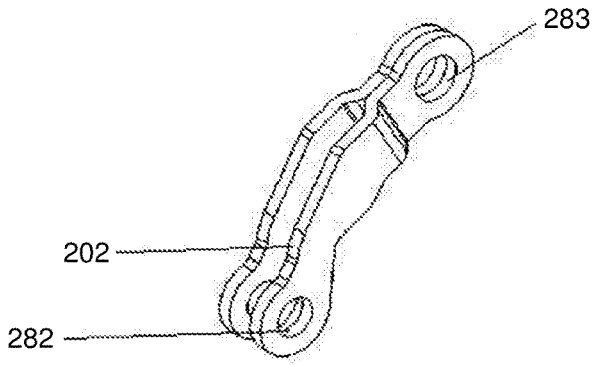

FIG. 2*a* and FIG. 2*b* illustrate a structural diagram of a tripping component. As shown in FIG. 2*a* and FIG. 2*b*, the tripping component 100 comprises a tripping buckle 204. A first hole 207 is provided at a first end of the tripping buckle 204, and a rotation shaft 208 is riveted in the first hole 207. A pin hole is provided at the middle of the tripping buckle 204, a pin 203 passes through the pin hole to rivet an upper connection rod 201 to the tripping buckle 204. A limiting hole is formed at a position close to the pin hole, and a limiting pin 205 is riveted in the limiting hole. FIG. 2*a* illustrates a structure after the limiting pin 205 is riveted, therefore the limiting hole is shielded. The position of the limiting hole is the position of the limiting pin 205. A second end of the tripping buckle 204 is hook shaped, a first inclined surface 256 is formed on an inner side of the hook, and a second inclined surface 253 is formed on an outer side of the hook. It should be noticed that, although the second inclined surface 253 is called "an inclined surface", it is actually an arc surface, or at least comprises an arc surface in part. An upper end of the upper connection rod 201 is riveted to the tripping buckle 204. A pin hole is provided in the middle of the upper connection rod 201, a pin 203 passes through the pin hole to rivet the lower connection rod 202 to the upper connection rod 201. A connection hole 236 is provided at a bottom end of the upper connection rod 201. As shown in FIG. 2*b*, a connection hole 283 is provided at an upper end of the lower connection rod 202. A pin passes through the connection hole 283 to rivet the lower connection rod 202 to the upper connection rod 201. A connection hole 282 is provided at a bottom end of the lower connection rod 202.

Figure 3A:
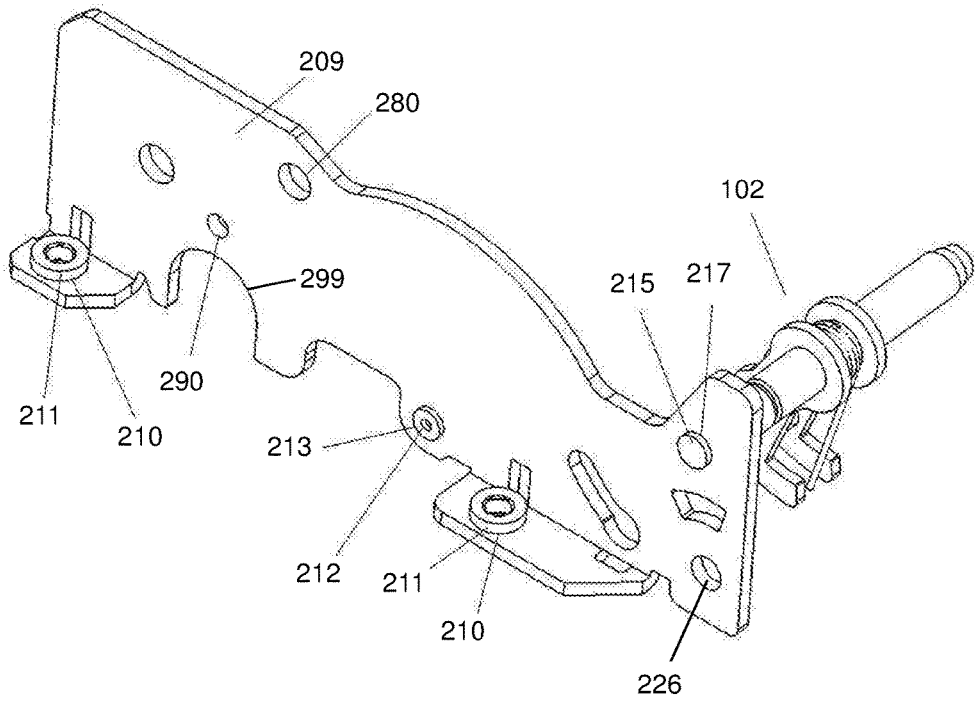
FIG. 3*a* illustrates a structural diagram of a left side plate component and a latch component of the operation mechanism of circuit breaker shown in FIG. 1.
Figure 3B:
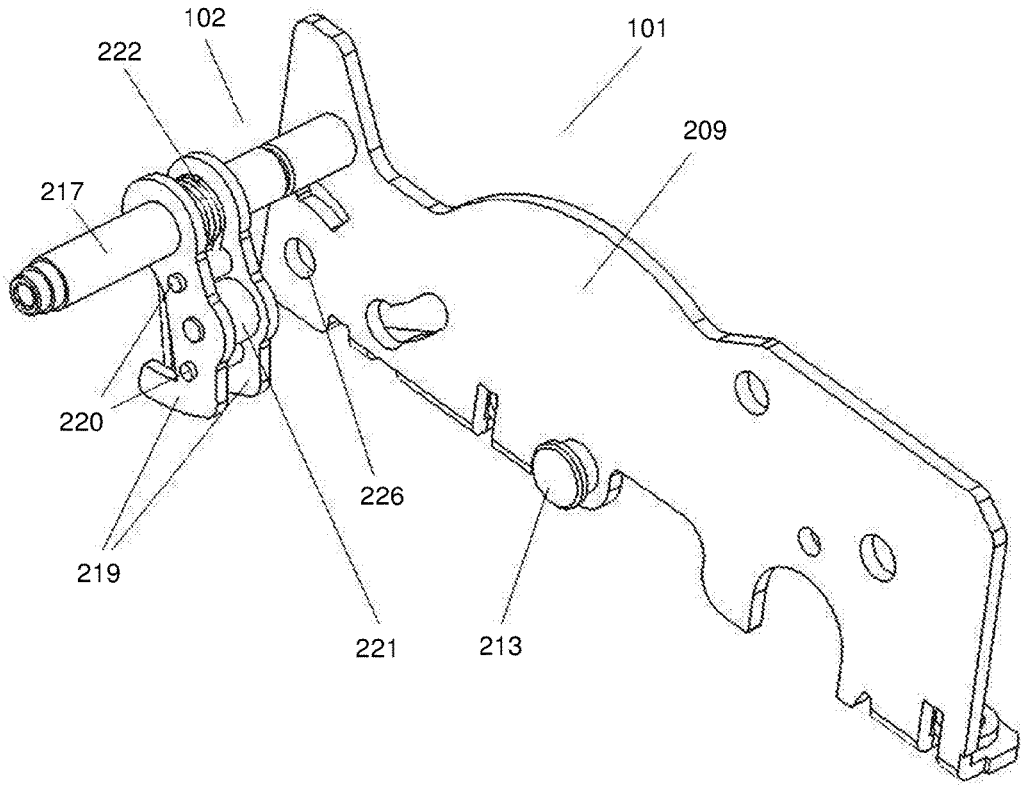
FIG. 3*b* illustrates a structural diagram of the left side plate component and the latch component from another perspective.

Side plate components comprise the left side plate component 101 and the right side plate component 104. The left side plate component 101 and the right side plate component 104 have symmetrical structures. As shown in FIG. 1, the tripping component 100, the latch component 102, the half shaft component 103, the lever component 105 and the main shaft component 106 are disposed between the left side plate component 101 and the right side plate component 104. And, the tripping component 102, the half shaft component 103, the lever component 105 and two ends of the main shaft component 106 are mounted on the left side plate component 101 and the right side plate component 104. FIG. 3*a* and FIG. 3*b* illustrate the structure of the left side plate component. FIG. 3*a* and FIG. 3*b* illustrate the structure of the left side plate component from different perspectives. As shown in the drawings, the left side plate component 101 comprises a left side plate 209. Bending holes 210 are formed in the bottom of the left side plate 209 at positions close to the two ends. The bending hole 210 comprises an extension plate perpendicular to the side plate 209 and a hole opened on the extension plate. A nut 211 is riveted on the bending hole 210. The bending hole 210 and the nut 211 are used to install the operation mechanism 107 onto the circuit breaker. A mounting hole 212 is provided in the middle of the left side plate 209 at a position close to the bottom. The mounting hole 212 is used for mounting a rotation shaft 213. The rotation shaft 213 is the rotation axis of the lever component 105. The lever component 105 rotates about the rotation shaft 213. As shown in FIG. 3*b*, the rotation shaft 213 is a short shaft. An end cap is provided on the end of the rotation shaft 213 which is facing to an inner side of the left side plate 209. A mounting hole 215 is provided on the left side plate 209 at a position close to the top of a second end. A rotation shaft 207, which is the rotation shaft of the tripping component 102, is mounted in the mounting hole 215, so that the tripping component 102 is mounted onto the left side plate 101. A half shaft hole 226 is provided on the left side plate 209 at a position close to the bottom the second end. The half shaft hole 226 is used to assemble the half shaft component 103. A semi-circular notch 299 is provided on the left side plate 209 at a position close to the bottom of a first end. The notch 299 is used to accommodate the main shaft component 106. A mounting hole 290 is provided above the notch 299, and is used for fixing a screw of the main shaft component 106. A tripping mounting hole 280 is provided on the left side plate 209 at a position close to the top of the first end. The tripping mounting hole 280 is used to accommodate a rotation shaft 208 of the tripping component 102.

Figure 5:
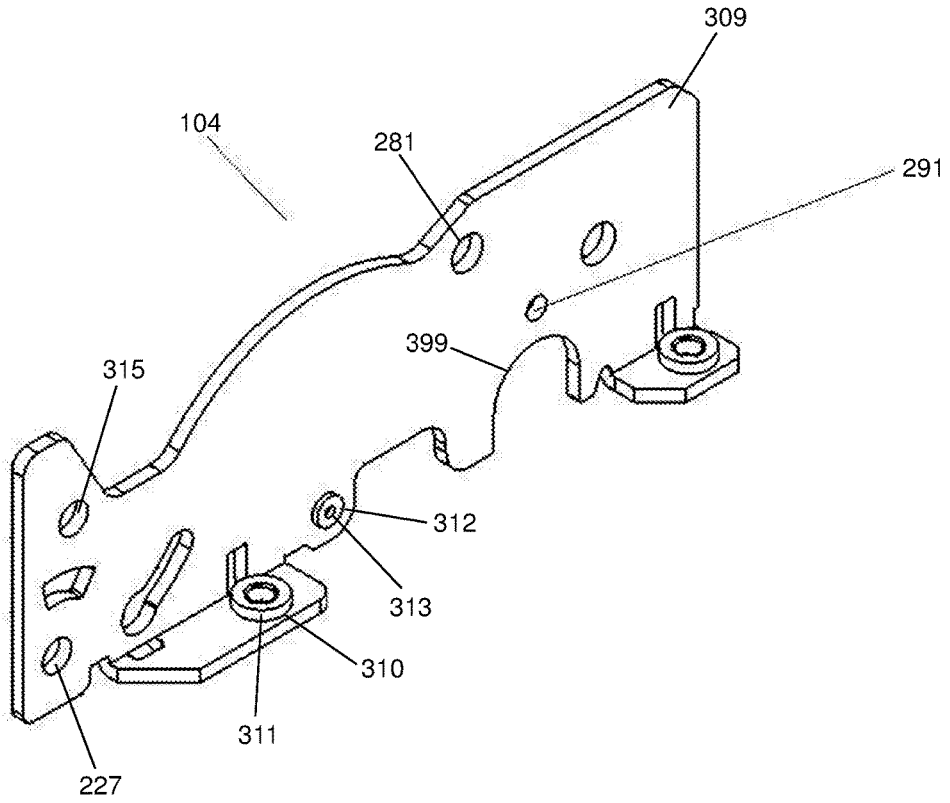
FIG. 5 illustrates a structural diagram of a right side plate component of the operation mechanism of circuit breaker as shown in FIG. 1.

FIG. 5 illustrates the structure of the right side plate component. The right side plate component 104 has a structure that is symmetrical to that of the left side plate component 101. A right side plate 309 is provided with the following structures which are symmetric to those of the left side plate 209: bending holes 310, a nut 311, a mounting hole 312 for mounting the rotation shaft 213, a mounting hole 315 for mounting the rotation shaft 217 of the tripping component 102, a half shaft hole 227 for assembling the half shaft component 103, a semi-circular notch 399 for accommodating the main shaft component 106, a mounting hole 291 for fixing a screw of the main shaft component 106 and a tripping mounting hole 281 for accommodating the rotation shaft 208 of the tripping component 102.

Figure 4A:
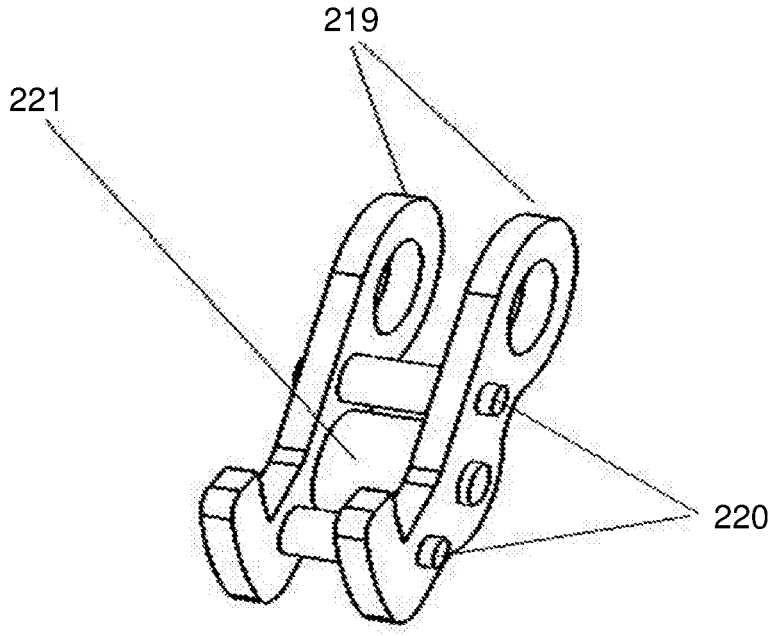
FIG. 4*a* illustrates a structural diagram of a latch component according to a first embodiment.
Figure 4B:
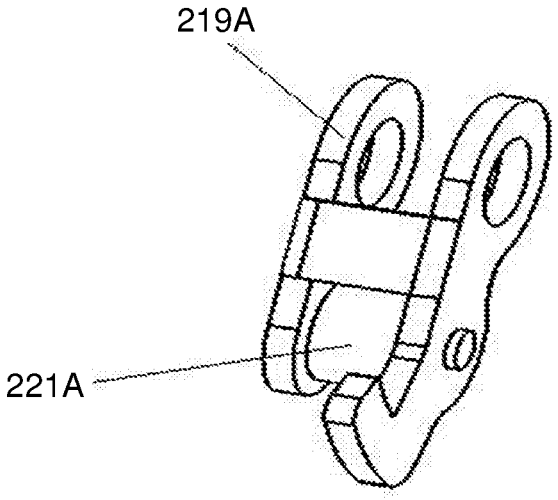
FIG. 4*b* illustrates a structural diagram of a latch component according to a second embodiment.

The latch component 102 comprises a sheet metal piece 219, a positioning shaft 220, a bearing 221, a latch component spring 222 and a rotation shaft 217. The structure of the latch component is shown in FIG. 3*a* and FIG. 3*b* and mainly shown in FIG. 3*b*. It should be noticed that, for the purpose of illustrating the mounting structure of the latch component 102 more clearly, FIG. 3*a* and FIG. 3*b* illustrate the structure of the side plate component 101 and the latch component 102 from two different perspectives. In the perspective of FIG. 3*b*, the mounting structure of the latch component is illustrated more clearly. FIG. 4*a* illustrates the structure of the sheet metal piece 219, the positioning shaft 220 and the bearing 221 of the latch component. The sheet metal piece 219 comprises two sheet metal sheets with identical shapes, and the two sheet metal sheets are arranged with a certain gap. Two positioning shafts 220 fix the two sheet metal sheets to form the sheet metal piece 219. The bearing 221 is disposed between the two sheet metal sheets, each of two ends of the bearing 221 are mounted on one sheet metal sheet respectively. The bearing 221 is positioned between the two positioning shafts 220. A shaft hole is provided on an upper end of the sheet metal piece 219. The sheet metal piece 219 is mounted on the rotation shaft 217 through the shaft hole, and the sheet metal piece 219 can rotate about the rotation shaft 217. The latch component spring 222 is fit on the rotation shaft 217, and is also disposed between the two sheet metal sheets. The bearing 221 cooperates with the second inclined surface 253 of the tripping component 100, so that the latch component 102 can limit the tripping component 100. FIG. 4*b* illustrates the structure of a latch component according to another embodiment. According to the structure shown in FIG. 4*b*, the sheet metal piece 219A comprises two sheet metal sheets with different shapes. A bending foot is provided on one sheet metal sheet, while the other sheet metal sheet is not provided with a bending foot. Both sheet metal sheets are provided with holes for the rotation shaft 217 to penetrate through. The two sheet metal sheets are arranged with a certain gap. The two sheet metal sheets are connected to each other via a sheet-shaped part instead of a positioning shaft. In other words, the sheet metal piece 219A is a single element with the sheet-shaped part and two sheet metal sheets connected by the sheet-shaped part. A bearing 221A is disposed between the two sheet metal sheets.

As shown in FIG. 1, the half shaft component 103 comprises a half shaft 223. Two ends of the half shaft 223 are installed in the half shaft hole 226 on the side plate 209 of the left side plate component 101 and the half shaft hole 227 on the side plate 309 of the right side plate component 104 respectively. Two fault receivers are provided on the half shaft component 103, that is, a first fault receiver 224 and a second fault receiver 225. The first fault receiver 224 and the second fault receiver 225 are both located between the left side plate component 101 and the right side plate component 104. The first fault receiver 224 is arranged close to an inner side of the side plate of the left side plate component 101, and the second fault receiver 225 is arranged close to an inner side of the side plate of the right side plate component 104. The half shaft component 103 and the latch component 102 form a two-level latch of the operation mechanism.

Figure 6A:
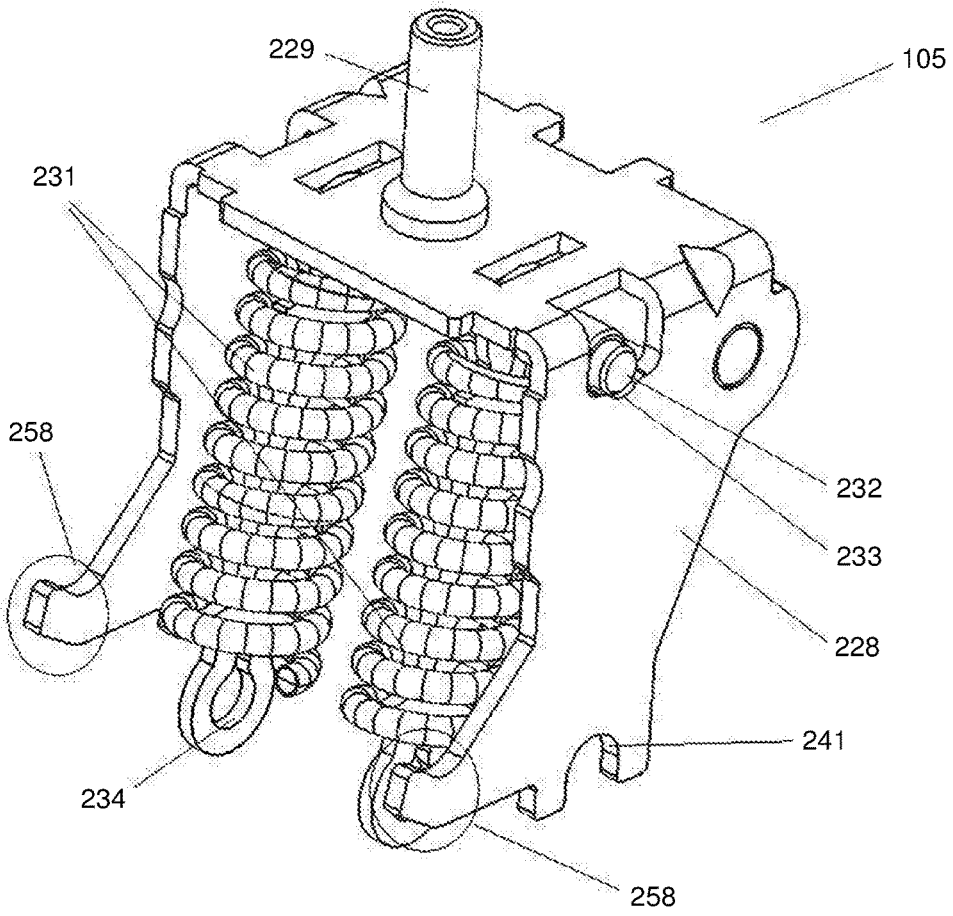
FIG. 6*a* and FIG. 6*b* illustrate a structural diagram of a lever component of the operation mechanism of circuit breaker as shown in FIG. 1.
Figure 6B:
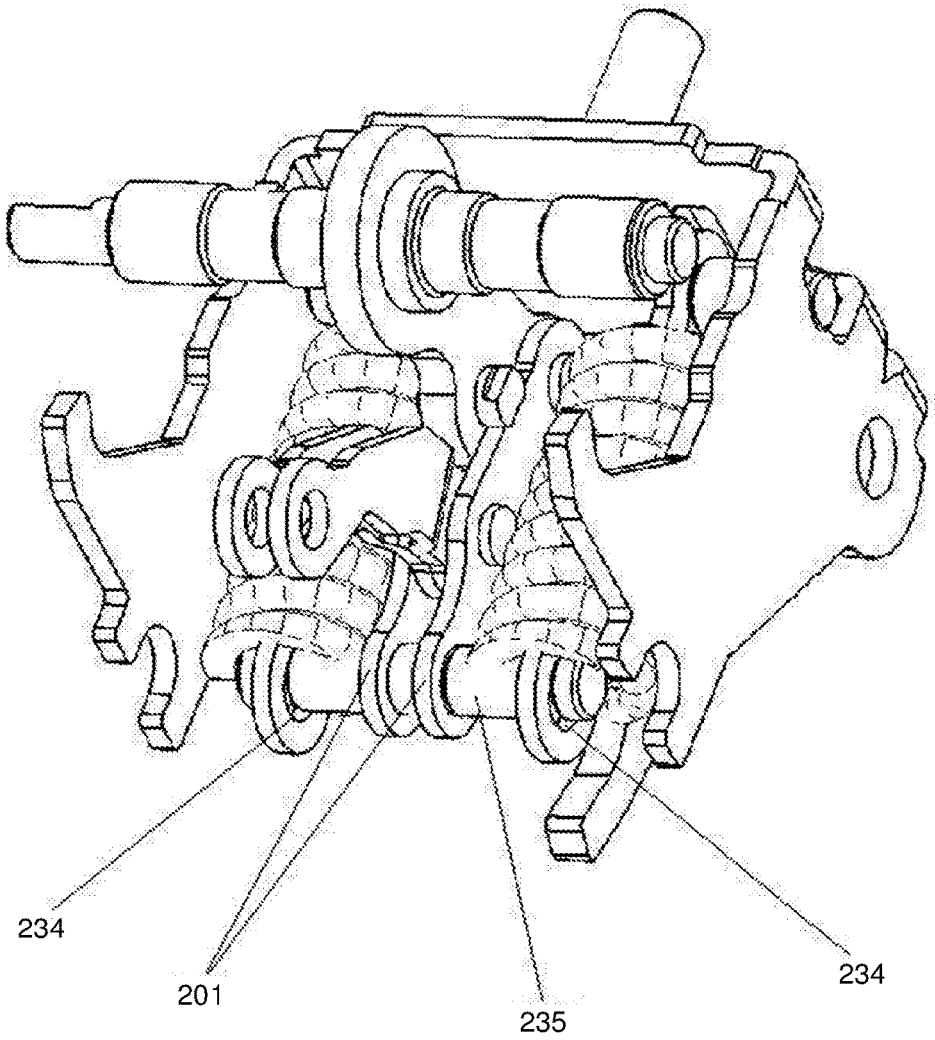

FIG. 6*a* and FIG. 6*b* illustrate the structure of the lever component. The lever component 105 comprises a sheet metal bending piece 228, which is bent to form a top wall and two side walls. The top wall and the two side walls form a semi-surrounding structure. A mounting shaft 229 is riveted to the top wall of the sheet metal bending piece 228, and is used for mounting an operation handle 230. Mounting grooves 233 are provided on the metal plate bending piece 228 at junctions of each side wall and the top wall. A spring mounting shaft 232 is mounted between the two mounting grooves 233. A top end of a lever component spring 231 is connected to the spring mounting shaft 232. According to the illustrated embodiment, two lever component springs 231 are arranged in parallel. The lever component spring 231 is surrounded by the sheet metal bending piece 228. A connection hole 234 is provided on a bottom end of the lever component spring 231. The connection hole 234 is aligned with the connection hole 236 at the bottom end of the upper connection rod 201. A connection shaft 235 penetrates through the connection hole 234 and the connection hole 236, so that the lever component spring 231 is connected with the upper connection rod 201 of the tripping component 100, and the lever component 105 is in linkage with the tripping component 101. The sheet metal bending piece 228 forms a shallow hook shaped extension part 258 at a first end of the bottom of the two side walls. The shallow hook shaped extension part 258 has a shape similar to a "boot". The shallow hook shaped extension part 258 limits the rotation of the lever component. Semi-circular notches 241 are formed in the bottom of the two side walls of the sheet metal bending piece 228 at a position close to a second end. The semi-circular notches 241 are used for accommodating the rotation shaft 213. The lever component 105 rotates about the rotation shaft 213.

Figures 7A, 7B:
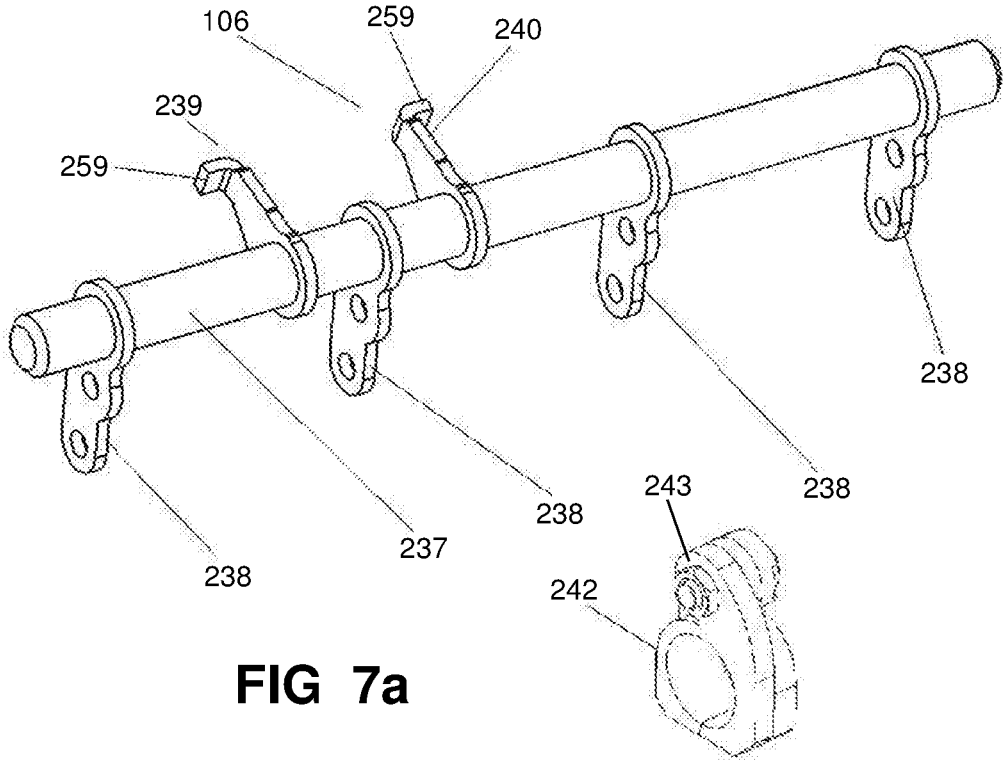
FIG. 7*a* and FIG. 7*b* illustrate a structural diagram of a main shaft component of the operation mechanism of circuit breaker as shown in FIG. 1.

FIG. 7*a* and FIG. 7*b* illustrate the structure of the main shaft component. The main shaft component 106 comprises a main shaft 237, and a plurality of cantilevers 238 are arranged on the main shaft 237. According to an embodiment, the plurality of cantilevers 238 are welded on the main shaft 237. The plurality of cantilevers 238 correspond to moving contact components with a plurality of poles respectively, in other words, correspond to multi-phase circuits. Each cantilever 238 is provided with a connection hole. A pair of main shaft limiting pieces 239, 240 is provided on the main shaft 237. The pair of main shaft limiting pieces 239, 240 is arranged on two sides of one of the plurality of cantilevers 238, and, the positions of the main shaft limiting pieces 239 and 240 on the main shaft 237 are symmetric relative to the cantilever 238. The main shaft limiting pieces 239 and 240 correspond to one phase of the multi-phase circuit. Bent limiting blocks 259 are provided on ends of the main shaft limiting pieces 239 and 240. The bent limiting block 259 can be matched with the shallow hook shaped extension part 258 with a "boot" shape on the sheet metal bending piece 228, so that and a rotation range of the lever component 105 is limited by using the main shaft component 106. FIG. 7*b* discloses a mounting accessory of the main shaft component. The mounting accessory includes two portions: a first portion 242 and a second portion 243. The first portion 242 and the second portion 243 are on a single element. A circular hole is formed in the first portion 242, and the diameter of the hole is matched with the diameter of the main shaft 237. The main shaft 237 penetrates through the hole. The second portion 243 is located above the first portion 242, and a screw hole is formed on the second portion 243. The left side plate component 101 and the right side plate component 104 are mounted with a mounting accessory respectively. The holes on the first portion 242 are aligned with the semi-circular notches 299 or 399 respectively, so as to accommodate the main shaft 237. The screw holes on the second portion 243 are aligned with the mounting hole 290 or the mounting hole 291 respectively. A screw penetrates through the mounting hole and the screw hole, so that the mounting accessory and the main shaft are mounted onto the left side plate component and the right side plate component.

As shown in FIG. 1, FIG. 2*a*, FIG. 2*b*, FIG. 3*a*, FIG. 3*b*, FIG. 4*a*, FIG. 4*b*, FIG. 5, FIG. 6*a*, FIG. 6*b*, FIG. 7*a* and FIG. 7*b*, the tripping component 100, the left side plate component 101, the latch component 102, the half shaft component 103, the right side plate component 104, the lever component 105 and the main shaft component 106 assemble as follows to form the operation mechanism 107. Two ends of the rotation shaft 208 of the tripping component 100 are mounted on the tripping mounting hole 280 of the left side plate component 101 (located on the left side plate 209) and the tripping mounting hole 281 of the right side plate component 104 (located on the right side plate 309) respectively. The semi-circular notches 241 in the bottom of the two side walls of the sheet metal bending piece 228 of the lever component 105 are respectively erected on the rotation shafts 213 of the left side plate component 101 and the right side plate component 104. As described above, the rotation shafts 213 are short shafts. Two rotation shafts 213 are mounted on the left side plate 209 and the right side plate 309 respectively. An end cap is provided on the end of the rotation shaft 213 facing to an inner side. The diameter of the end cap is larger than that of the rotation shaft. The end cap is used for horizontally limiting the side wall of the sheet metal bending piece 228. The connection hole 234 in the bottom of the lever component spring 231 of the lever component 105 is aligned with the connection hole 236 at the lower end of the upper connection rod 201. The connection shaft 235 penetrates through the connection hole 234 and the connection hole 236, so that the lever component spring 231 is connected with the upper connection rod 201. The main shaft 237 of the main shaft component 106 passes through the holes on the first portions 242 of the two mounting accessories, so that the main shaft 237 is connected to the two mounting accessories. The main shaft 237 is placed in the semi-circular notch 299 of the left side plate component 101 (located on the left side plate 209) and the semi-circular notch 399 of the right side plate component 104 (located on the right side plate 309). The screw holes in the second portions 243 of the two mounting accessories align with the mounting hole 290 on the left side plate component 101 (located on the left side plate 209) and the mounting hole 291 on the right side plate component 104 (located on the right side plate 309) respectively. Screws pass through the screw holes in the second portions 243 of the two mounting accessories and the mounting holes 290, 291, so that the mounting accessories are fixed on the left side plate component and the right side plate component, then the main shaft component 106 is assembled to the left side plate component 101 and the right side plate component 104. One of the cantilevers 238 of the main shaft component 106 is connected to the lower connection rod 202 of the tripping component 100. The connection hole on the cantilever 238 is connected with the connection hole 282 at the lower end of the lower connecting rod 202 through a pin shaft 246 (the pin shaft 246 is shown in FIG. 11), so that a connection rod structure is formed and the main shaft component 106 is connected with the tripping assembly 100. For a multi-phase circuit with a multi-pole structure, the main shaft component 106 is provided with a plurality of cantilevers 238 and each cantilever 238 corresponds to one pole. The operation mechanism 107 is mounted on the structure of one pole. The cantilever 238 corresponding to the pole is connected with the lower connection rod in the tripping component of the operation mechanism. For the fixing of the left side plate component 101 and the right side plate component 104, in addition to the rotation shaft 217 of the latch component 102, another fixing shaft 247 is provided on the other end of the latch component 102. The fixing shaft 247 also penetrates through the holes in the left side plate component and the right side plate component and is fixed by screws. The fixing shaft 247 and the rotation shaft 217 are used for connecting the left side plate component 101 and the right side plate component 104.

Figure 8:
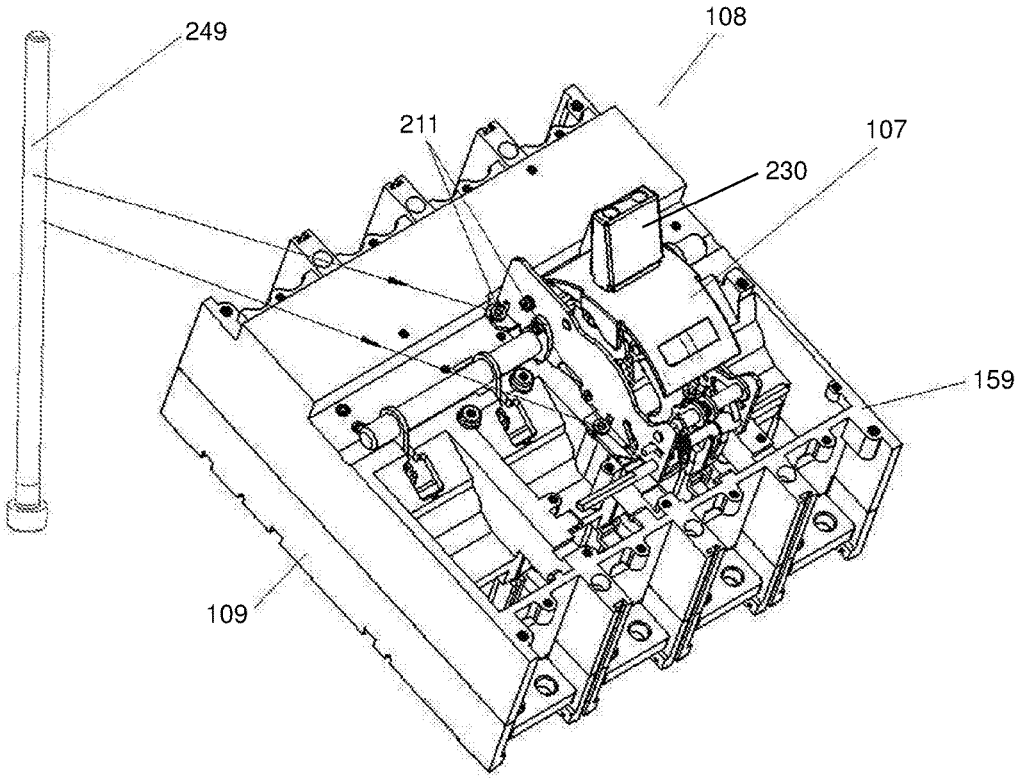
FIG. 8 illustrates an assembly structural diagram of an operation mechanism as shown in FIG. 1 and a circuit breaker.
Figure 9:
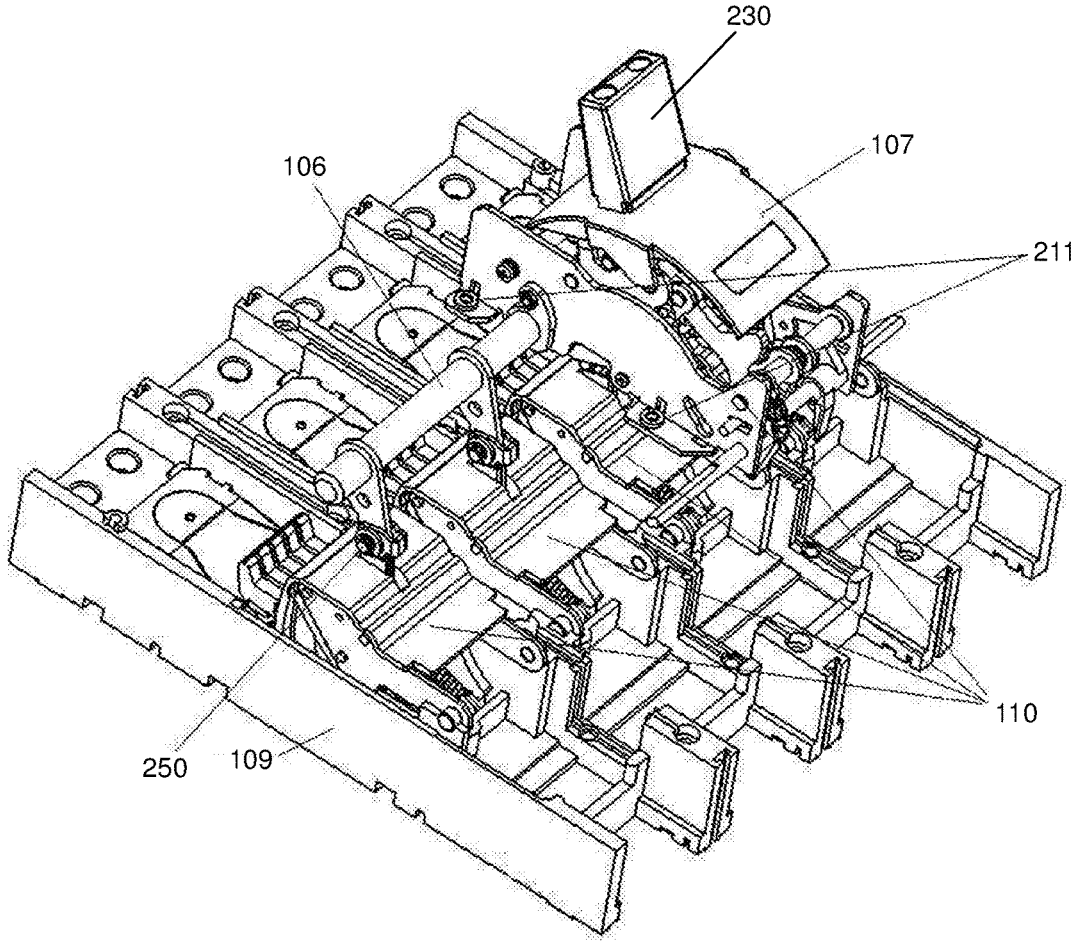
FIG. 9 illustrates an assembly structural diagram of an operation mechanism as shown in FIG. 1 and a circuit breaker.

As shown in FIG. 8 and FIG. 9, the assembly structure of the operation mechanism 107 and the circuit breaker 108 is illustrated. FIG. 8 and FIG. 9 illustrate the structure of the circuit breaker without a lid. As shown in FIG. 8 and FIG. 9, the circuit breaker 108 includes a base 109 and a middle cover 159. According to the illustrated embodiment, the circuit breaker 108 is a multi-pole circuit breaker with multi-pole moving contacts 110 corresponding to multi-phase circuits. The operation mechanism 107 is mounted on one moving contact corresponding to one pole. The screw 249 is matched with the nut 211 on the left side plate component 101 and the right side plate component 104 of the operation mechanism, so that the left side plate component 101 and the right side plate component 104 are fixed on the middle cover 159, then the operation mechanism 107 is mounted on a moving contact of one pole. The multi-pole moving contacts 110 are respectively connected to the corresponding cantilevers 238 of the main shaft component 106 through the pin shafts 250, and the moving contact 110 of each pole is connected to a cantilever 238 corresponding to the moving contact 110. The pin shaft 250 is fixed in a connection hole on the cantilever 238. As shown in FIG. 7*a*, two connection holes are provided on each cantilever 238. The upper connection hole is used for connecting with the tripping component, and the lower connection hole is used for connecting with the moving contact. The operation handle 230 is mounted on the lever component 105, and more specifically, the operation handle 230 is mounted on the mounting shaft 229.

Figure 10A:
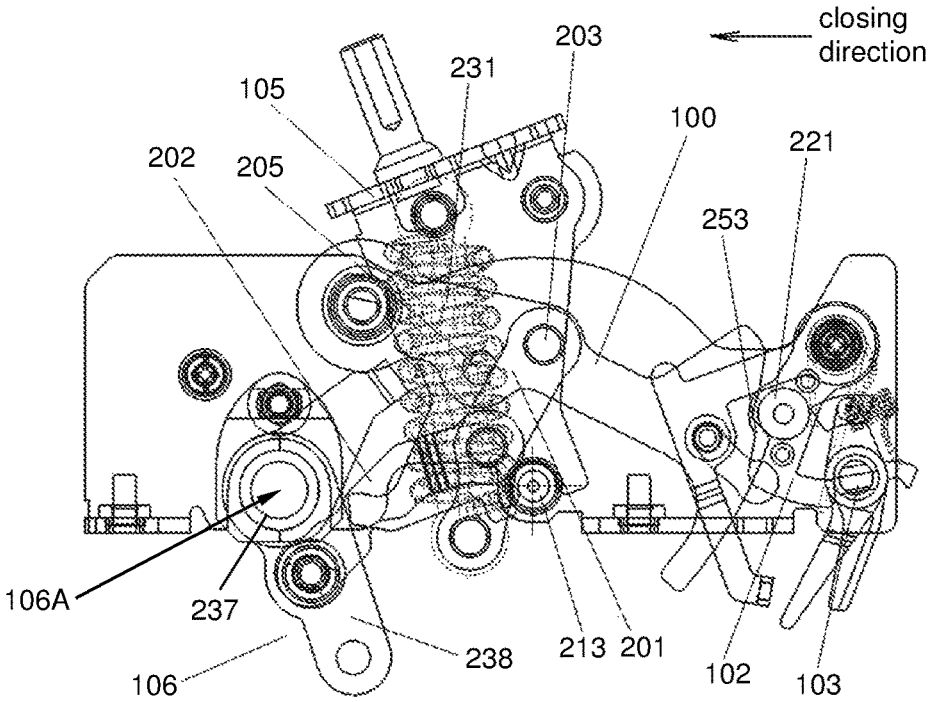
FIG. 10*a* and FIG. 10*b* illustrate a closing process of a moving contact driving by the operation mechanism as shown in FIG. 1.
Figure 10B:
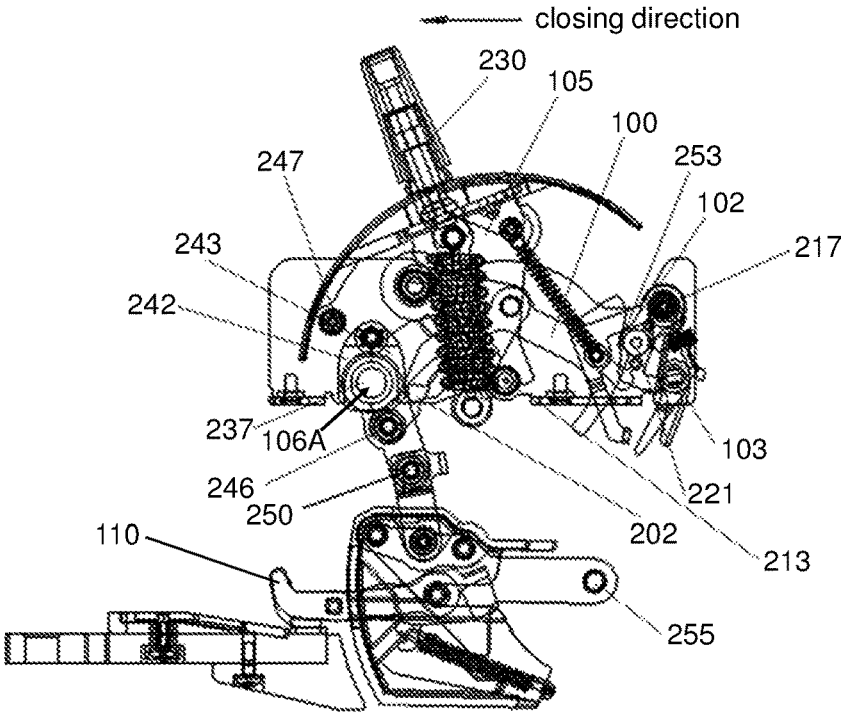

FIG. 10*a* and FIG. 10*b* illustrate a closing process of a moving contact driving by the operation mechanism described above. FIG. 10*a* mainly illustrates the closing process of the operation mechanism. FIG. 10*b* illustrates the closing process of the moving contact driven by the operation mechanism. When performing the closing process, the second inclined surface 253 formed on the outer side of the hook shaped tail end of the tripping buckle 204 of the tripping component 100 is pressed by the bearing 221 and is limited by the bearing 221. The sheet metal piece 219 of the latch component 102 is limited by the half shaft 223 of the half shaft component 103. The lever component 105 rotates anticlockwise about the rotation shaft 213 under an action of human force, for example, the operation handle 230 is pushed by human force to drive the lever component to rotate. According to the embodiment shown in FIG. 10*a* and FIG. 10*b*, the closing direction in the drawings is indicated by arrows, the lever component rotates anticlockwise. When the lever component 105 is driven to rotate anticlockwise, the lever component spring 231 drives the upper connection rod 201 to rotate by taking the pin shaft 203 as a rotation shaft. The upper connection rod 201 rotates clockwise about the pin shaft 203. The upper connection rod 201 drives the lower connection rod 202 to move. The lower connection rod 202 drives the cantilever 238 of the main shaft component 106 (the cantilever 238 is connected with the tripping component 100) through the pin shaft 246. The cantilever 238 further drives the main shaft 237 to rotate about an axis 106A of the main shaft 237 clockwise. The rotation of the main shaft 237 drives other cantilevers 238 to move in linkage. The respective cantilevers 238 drive the respective moving contacts 110 through the pin shafts 250 to complete the closing process. The respective moving contacts 110 rotate anticlockwise about respective rotation centers 255. Back to FIG. 2*a*, a limit position of a clockwise rotation of the upper connection rod 201 is limited by the limiting pin 205. When the upper connection rod 201 rotates to be in contact with the limiting pin 205, the upper connection rod 201 does not rotate any further. Then, after the closing process is completed, the upper connection rod 201 is limited by a limiting pin 205.

Figure 11A:
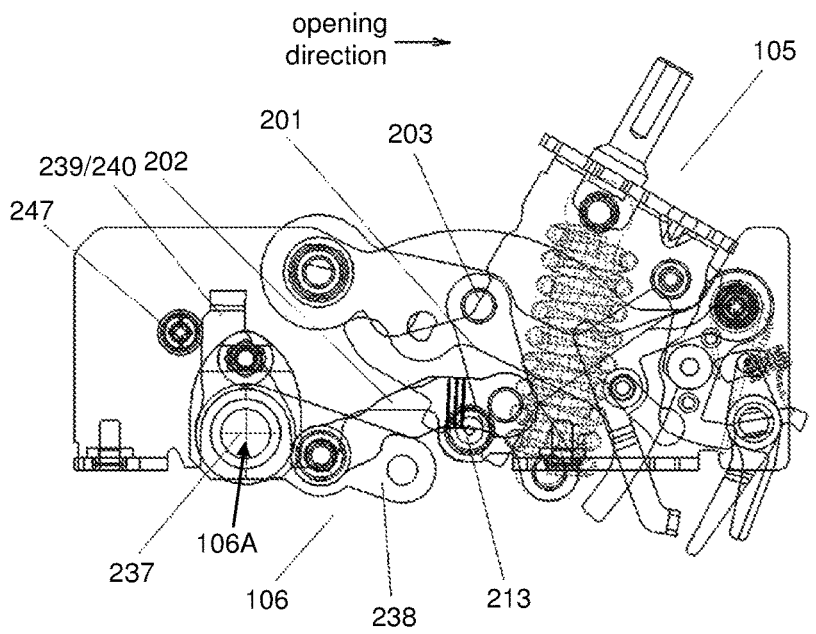
FIG. 11*a* and FIG. 11*b* illustrate an opening process of a moving contact driving by the operation mechanism as shown in FIG. 1.
Figure 11B:
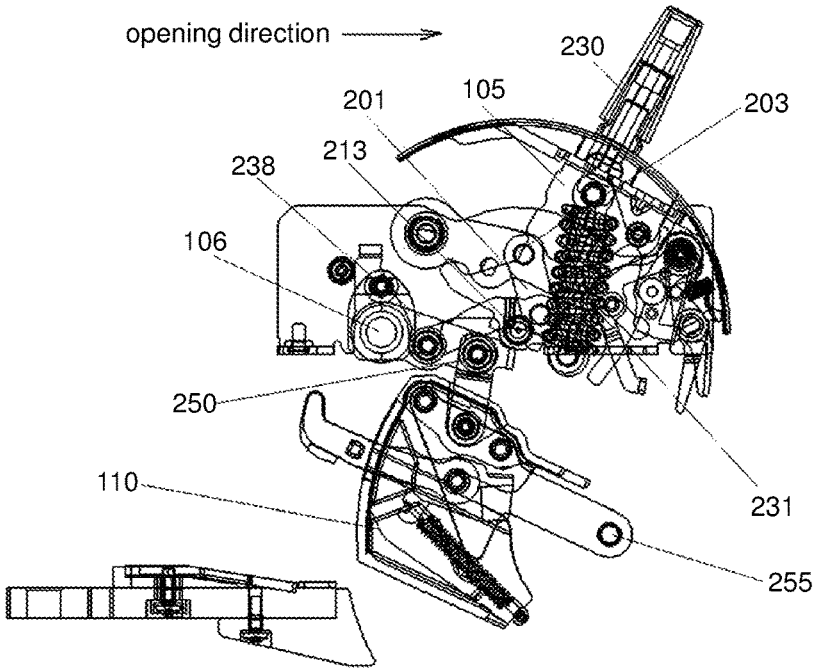

FIG. 11*a* and FIG. 11*b* illustrate an opening process of a moving contact driving by the operation mechanism described above. FIG. 11*a* mainly illustrates the opening process of the operation mechanism. FIG. 11*b* illustrates the opening process of the moving contact driven by the operation mechanism. When performing the opening process, the lever component 105 rotates clockwise about the rotation shaft 213 under an action of human force, for example, the operation handle 230 is pushed by human force to drive the lever component to rotate. According to the embodiment shown in FIG. 11*a* and FIG. 11*b*, the opening direction in the drawings is indicated by arrows, the lever component rotates clockwise. When the lever component 105 is driven to rotate clockwise, the lever component spring 231 drives the upper connection rod 201 to rotate by taking the pin shaft 203 as a rotation shaft. The upper connection rod 201 rotates anticlockwise about the pin shaft 203. The upper connection rod 201 drives the lower connection rod 202 to move. The lower connection rod 202 drives the cantilever 238 of the main shaft component 106 (the cantilever 238 is connected with the tripping component 100) through the pin shaft 246. The cantilever 238 further drives the main shaft 237 to rotate about the axis 106A of the main shaft 237 anticlockwise. The rotation of the main shaft 237 drives other cantilevers 238 to move in linkage. The respective cantilevers 238 drive the respective moving contacts 110 through the pin shafts 250 to complete the opening process. The respective moving contacts 110 rotate clockwise about respective rotation centers 255. As shown in FIG. 7*a*, a limit position of an anticlockwise rotation of the main shaft 237 is limited by the main shaft limiting pieces 239, 240 and the fixing shaft 247. As shown in FIG. 11*a* and FIG. 11*b*, when the main shaft limiting pieces 239, 240 are in contact with the fixing shaft 247, the main shaft component does not rotate any further.

Figure 12A:
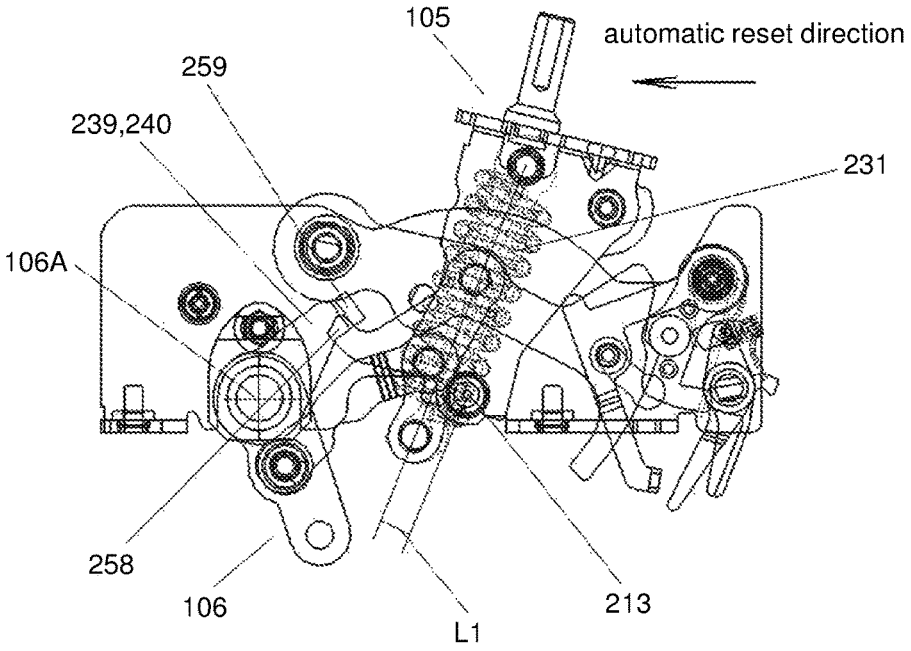
FIG. 12*a* and FIG. 12*b* illustrate a structural diagram of the operation mechanism according to an embodiment of the present invention with a fusion welding isolation indication.
Figure 12B:
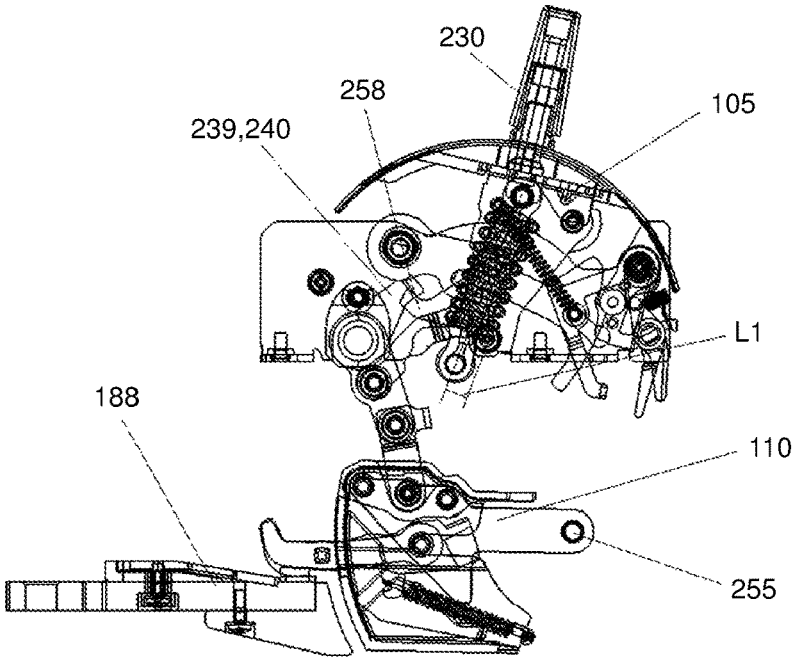

FIG. 12*a* and FIG. 12*b* illustrate a structural diagram of the operation mechanism according to an embodiment of the present invention with a fusion welding isolation indication. FIG. 12*a* mainly illustrates the structure of the operation mechanism during the fusion welding isolation indication. FIG. 12*b* illustrates the structure of the operation mechanism and the moving contact during the fusion welding isolation indication. When a moving contact 110 in the multi-pole moving contact is subjected to fusion welding, the moving contact 110 is fixed to the static contact 188 due to fusion welding and cannot rotate about the rotation center 255. The main shaft component 106 is in linkage with the moving contact 110, so that the main shaft component 106 cannot rotate about the rotation center 106*a* when the moving contact is fusion welded, in other words, the main shaft component 106 is locked at the closing position. At the moment, if the lever component 105 is operated manually to open, the mechanism is easy to be damaged because the main shaft component 106 is locked. In order to avoid such a situation, the operation mechanism of the invention is provided with an isolation protection function directing to the fusion welding situation. The isolation protection function is implemented by a limiting block 259 on the ends of the main shaft limiting piece 239, 240 and the shallow hook shaped extension part 258 with a "boot" shape on the sheet metal bending piece 228. As shown in FIG. 12*a* and FIG. 12*b*, when a fusion welding occurs, if the operation handle 230 is operated manually to rotate clockwise for an opening action, after the lever component 105 rotates clockwise for a certain angle, the limiting block 259 will be in contact with the shallow hook shaped extension portion 258 with a "boot" shape, so that the lever component 105 cannot rotate anymore and cannot reach the opening position. When the manual operation disappears, a torque exists under the action of the lever component spring 231. A force arm of the torque is L1. The lever component spring 231 generates the torque through the force arm L1 and drives the lever component 105 to rotate anticlockwise about the rotation shaft 213 to return to the closing position. The direction indicated by an arrow in FIG. 12*a* is the direction when the lever component 105 automatically resets under the action of the torque, the direction is anticlockwise rotation.

The fusion welding isolation mechanism for operation mechanism of circuit breaker of the present invention can limit a rotation stroke of the operation mechanism towards an opening direction, so as to prevent the operation mechanism from being damaged by forced operation. After an external force disappears, the operation mechanism can reset to a closing position automatically.

The above embodiments are provided to those skilled in the art to realize or use the invention, under the condition that various modifications or changes being made by those skilled in the art without departing the spirit and principle of the invention, the above embodiments may be modified and changed variously, therefore the protection scope of the invention is not limited by the above embodiments, rather, it should conform to the maximum scope of the innovative features mentioned in the Claims.

What is claimed is:

1. A fusion welding isolation mechanism for operation mechanism of circuit breaker, wherein the operation mechanism of circuit breaker comprises: a tripping component, a left side plate component, a right side plate component, a latch component, a half shaft component, a lever component and a main shaft component;

the tripping component, the latch component and the lever component are mounted between the left side plate component and the right side plate component, the half shaft component and the main shaft component penetrate through the left side plate component and the right side plate component and extend out of the left side plate component and the right side plate component;

the tripping component, the latch component, the half shaft component, the lever component and the main shaft component move in linkage;

the lever component and the main shaft component are provided with isolation devices for preventing an operation handle from an opening operation when a moving contact is subject to fusion welding.

2. The fusion welding isolation mechanism for operation mechanism of circuit breaker according to claim 1, wherein the main shaft component comprises a main shaft with a plurality of cantilevers arranged thereon, a main shaft limiting piece is provided on the main shaft and a limiting block is provided on the main shaft limiting piece.

3. The fusion welding isolation mechanism for operation mechanism of circuit breaker according to claim 2, wherein the lever component comprises a sheet metal bending piece, the sheet metal bending piece being bent to form a top wall and two side walls; a lever component spring is mounted on the sheet metal bending piece, the lever component spring is surrounded by the sheet metal bending piece, the sheet metal bending piece forms a shallow hook shaped extension part at a first end of the bottom of the two side walls.

4. The fusion welding isolation mechanism for operation mechanism of circuit breaker according to claim 3, wherein the isolation devices comprise the limiting block on the main shaft limiting piece and the shallow hook shaped extension part on the sheet metal bending piece.

5. The fusion welding isolation mechanism for operation mechanism of circuit breaker according to claim 4, wherein when a moving contact is subjected to fusion welding, the main shaft component in linkage with the moving contact is locked at the closing position and is not able to rotate; when the lever component rotates towards an opening direction under an external force, the limiting block on the main shaft liming piece is in contact with the shallow hook shaped extension portion on the sheet metal bending piece, so that the lever component is not able to reach the opening position.

6. The fusion welding isolation mechanism for operation mechanism of circuit breaker according to claim 5, wherein when the external force disappears, the lever component spring generates a torque for driving the lever component to rotate towards a closing direction and reset.

* * * * *